US010174707B2

(12) United States Patent
Maki et al.

(10) Patent No.: US 10,174,707 B2
(45) Date of Patent: Jan. 8, 2019

(54) INTERNAL COMBUSTION ENGINE AND METHOD OF FORMING

(71) Applicant: Ford Global Technologies, LLC, Dearborn, MI (US)

(72) Inventors: Clifford E. Maki, New Hudson, MI (US); Antony George Schepak, Howell, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 15/454,169

(22) Filed: Mar. 9, 2017

(65) Prior Publication Data

US 2018/0258878 A1 Sep. 13, 2018

(51) Int. Cl.
*F02F 1/14* (2006.01)
*F02F 1/00* (2006.01)

(52) U.S. Cl.
CPC ..... *F02F 1/14* (2013.01); *F02F 1/004* (2013.01); *F02F 2200/08* (2013.01)

(58) Field of Classification Search
CPC .... B22D 19/0009; B22D 17/24; B22D 17/00; B22D 19/0072; B22D 15/00; F02F 1/10; F02F 1/004; F02F 1/108; F02F 1/16; F02F 7/0021; F02F 1/00; F02F 1/002; F02F 1/166
See application file for complete search history.

(56) References Cited

U.S. PATENT DOCUMENTS

| | | | | |
|---|---|---|---|---|
| 5,755,028 | A | 5/1998 | Takami et al. | |
| 6,478,073 | B1 * | 11/2002 | Grebe | B22C 9/10 164/132 |
| 8,820,389 | B1 | 9/2014 | Degler | |
| 9,442,034 | B2 | 9/2016 | Moetakef et al. | |
| 2005/0214118 | A1 * | 9/2005 | Dodd | F01D 5/147 416/97 R |
| 2006/0124082 | A1 | 6/2006 | Grunenberg et al. | |
| 2016/0040621 | A1 * | 2/2016 | Beyer | B22D 17/00 123/193.1 |
| 2016/0341148 | A1 * | 11/2016 | Maki | F02F 7/0058 |

OTHER PUBLICATIONS

U.S. Appl. No. 15/056,201, entitled "Extruded Cylinder Liner", filed Feb. 29, 2016, 32 pages.

* cited by examiner

*Primary Examiner* — Long T Tran
(74) *Attorney, Agent, or Firm* — Brooks Kushman P.C.; Julia Voutyras

(57) ABSTRACT

A tool and a method of forming an engine using the tool are provided. The tool includes an insert and at least one die. The insert is formed by forming an interbore passage between first and second siamesed cylinder liners, casting a lost core, and then casting a metal shell. The insert is positioned into a die of the tool and the engine block is cast. The lost core material may then be removed to provide the cooling jacket. The engine includes a cylinder block with a cooling jacket circumferentially surrounding first and second siamesed cylinder liners intersecting a closed deck face. The cooling jacket has first and second widths in first and second axial sections, respectively. An interbore region of the first and second cylinder liners defines first and second interbore cooling passages spaced apart from the deck face and parallel to one another.

20 Claims, 7 Drawing Sheets

INTERNAL COMBUSTION ENGINE AND METHOD OF FORMING

TECHNICAL FIELD

Various embodiments relate to a cylinder block for an internal combustion engine and a method and a tool for making or forming the engine.

BACKGROUND

An internal combustion engine cylinder block may be formed using a high pressure die casting method. A conventional cylinder block formed using this method typically results in an open deck face cooling jacket configuration with the depth of the water jacket being package contained by the head bolt pattern and head bolt size. The head bolt columns may be sized for structural stiffness and positioned for proper clamp loading. The wall thickness of the cylinder bore or cylinder liner may be selected based on combustion pressures and clamp load exerted by the head bolts. Structural limitations and materials selection also play a role in the design of the internal combustion cylinder block and the resulting performance for the engine system. For example, a conventional cooling jacket in an engine cylinder block formed using a high pressure die casting method in combination with bore size and bore pitch along with the head bolt size and pattern provides the size and shape of the resulting cooling jacket opening at the deck face. Additionally, the shape of the cooling jacket in the conventional block may be limited based on use of a blade die with a specified draft angle during the high pressure casting process. The shape and size of the cooling jacket may affect the engine performance based on both thermal and structural considerations.

SUMMARY

In an embodiment, a method of forming an engine is provided. An interbore passage is formed between first and second siamesed cylinder liners. A lost core is cast core about an outer surface of the liners. A metal shell is cast about the lost core and the liners to form an insert. The insert is positioned into a tool. An engine block is cast about the insert in the tool. The lost core is removed from the block to form a cooling jacket.

In another embodiment, a tool is provided with an insert and at least one die configured to receive the insert and having a cylinder block forming surface. The insert includes first and second siamesed cylinder liners having at least one interbore passage formed therein, and a lost core material formed about an outer surface of the liners. The lost core material has a decreasing thickness in an axial direction. The insert has a metal shell encapsulating the lost core and the liners.

In yet another embodiment, an engine is provided with a cylinder block having first and second siamesed cylinder liners intersecting a closed deck face. The block defines a cooling jacket circumferentially surrounding the cylinder liners. The cooling jacket has an upper wall spaced apart from the deck face, a first width along a first axial section of the liners, and a second width along a second axial section of the liners. The second axial section is positioned between the deck face and the first axial section, and the first width is less than the second width. An interbore region of the first and second cylinders defines first and second interbore cooling passages extending thereacross, with the first and second interbore passages spaced apart from the deck face and parallel to one another.

DETAILED DESCRIPTION

As required, detailed embodiments are disclosed herein; however, it is to be understood that the disclosed embodiments are merely exemplary and may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

Figure 1:
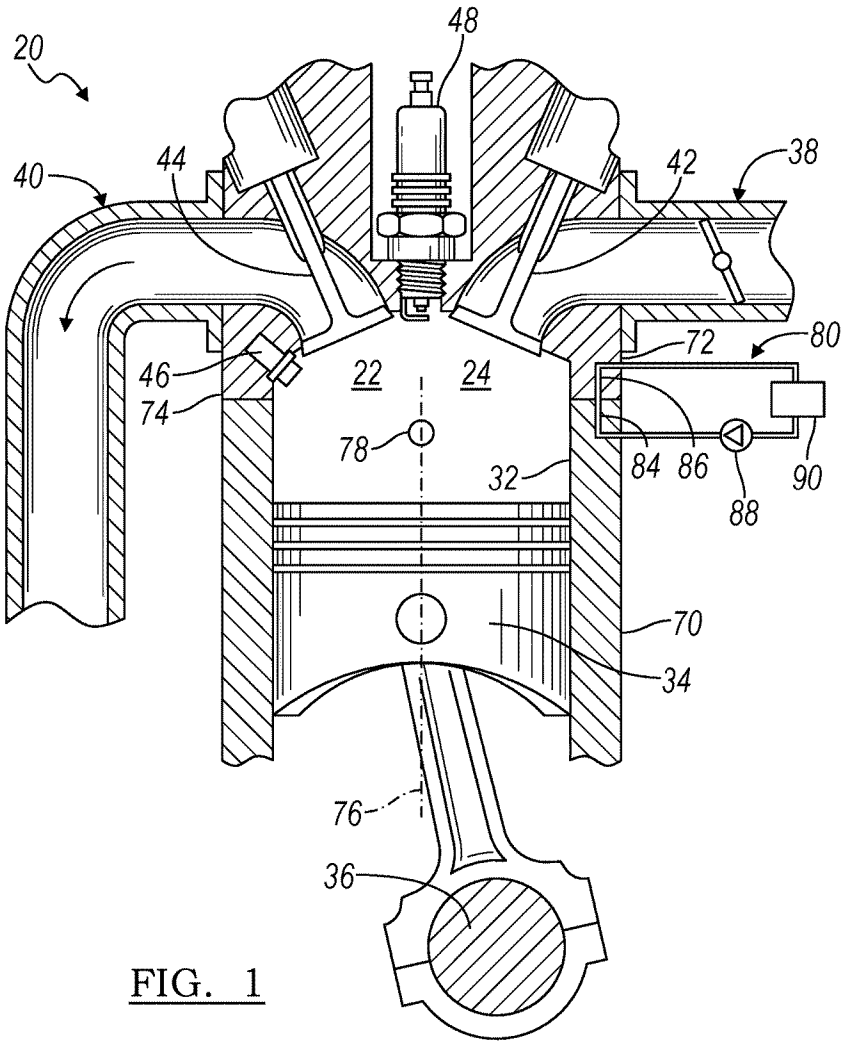
FIG. 1 illustrates a schematic of an internal combustion engine according to an embodiment.

FIG. 1 illustrates a schematic an internal combustion engine 20. The engine 20 has a plurality of cylinders 22, and one cylinder is illustrated. In one example, the engine 20 is an in-line four cylinder engine, and, in other examples, has other arrangements and numbers of cylinders. In one example, the cylinders may be arranged in a siamesed configuration, for example, as an interconnected gang of cylinders. In various examples, the cylinder block may have a closed deck configuration, or a semi-open deck configuration. The engine 20 block and cylinder head may be cast from aluminum, an aluminum alloy, or another metal. In another example, the engine 20 block and/or cylinder head may be cast or molded from a composite material, including a fiber reinforced resin, and other suitable materials.

The engine 20 has a combustion chamber 24 associated with each cylinder 22. The cylinder 22 is formed by cylinder walls 32. The cylinder and piston 34 cooperate to define the combustion chamber 24. The cylinder walls 32 may be formed by a cylinder liner as described below, and the cylinder liner may be a different material than the block, or the same material as the block.

The piston 34 is connected to a crankshaft 36. The combustion chamber 24 is in fluid communication with the intake manifold 38 and the exhaust manifold 40. An intake valve 42 controls flow from the intake manifold 38 into the combustion chamber 24. An exhaust valve 44 controls flow from the combustion chamber 24 to the exhaust manifold 40.

The intake and exhaust valves 42, 44 may be operated in various ways as is known in the art to control the engine operation.

A fuel injector 46 delivers fuel from a fuel system directly into the combustion chamber 30 such that the engine is a direct injection engine. A low pressure or high pressure fuel injection system may be used with the engine 20, or a port injection system may be used in other examples. An ignition system includes a spark plug 48 that is controlled to provide energy in the form of a spark to ignite a fuel air mixture in the combustion chamber 30. In other embodiments, other fuel delivery systems and ignition systems or techniques may be used, including compression ignition.

The engine 20 includes a controller and various sensors configured to provide signals to the controller for use in controlling the air and fuel delivery to the engine, the ignition timing, the power and torque output from the engine, and the like. Engine sensors may include, but are not limited to, an oxygen sensor in the exhaust manifold 40, an engine coolant temperature, an accelerator pedal position sensor, an engine manifold pressure (MAP sensor), an engine position sensor for crankshaft position, an air mass sensor in the intake manifold 38, a throttle position sensor, and the like.

In some embodiments, the engine 20 is used as the sole prime mover in a vehicle, such as a conventional vehicle, or a stop-start vehicle. In other embodiments, the engine may be used in a hybrid vehicle where an additional prime mover, such as an electric machine, is available to provide additional power to propel the vehicle.

Each cylinder 22 may operate under a four-stroke cycle including an intake stroke, a compression stroke, an ignition stroke, and an exhaust stroke. In other embodiments, the engine may operate with a two stroke cycle. In other examples, the engine 20 may operate as a two-stroke cycle. During the intake stroke, the intake valve 42 opens and the exhaust valve 44 closes while the piston 34 moves from the top of the cylinder 22 to the bottom of the cylinder 22 to introduce air from the intake manifold to the combustion chamber. The piston 34 position at the top of the cylinder 22 is generally known as top dead center (TDC). The piston 34 position at the bottom of the cylinder is generally known as bottom dead center (BDC).

During the compression stroke, the intake and exhaust valves 42, 44 are closed. The piston 34 moves from the bottom towards the top of the cylinder 22 to compress the air within the combustion chamber 24.

Fuel is then introduced into the combustion chamber 24 and ignited. In the engine 20 shown, the fuel is injected into the chamber 24 and is then ignited using spark plug 48. In other examples, the fuel may be ignited using compression ignition.

During the expansion stroke, the ignited fuel air mixture in the combustion chamber 24 expands, thereby causing the piston 34 to move from the top of the cylinder 22 to the bottom of the cylinder 22. The movement of the piston 34 causes a corresponding movement in crankshaft 36 and provides for a mechanical torque output from the engine 20.

During the exhaust stroke, the intake valve 42 remains closed, and the exhaust valve 44 opens. The piston 34 moves from the bottom of the cylinder to the top of the cylinder 22 to remove the exhaust gases and combustion products from the combustion chamber 24 by reducing the volume of the chamber 24. The exhaust gases flow from the combustion cylinder 22 to the exhaust manifold 40 and to an after treatment system such as a catalytic converter.

The intake and exhaust valve 42, 44 positions and timing, as well as the fuel injection timing and ignition timing may be varied for the various engine strokes.

The engine 20 has a cylinder head 72 that is connected to a cylinder block 70 or a crankcase to form the cylinders 22 and combustion chambers 24. A head gasket 74 is interposed between the cylinder block 70 and the cylinder head 72 to seal the cylinders 22. Each cylinder 22 is arranged along a respective cylinder axis 76. For an engine with cylinders 22 arranged in-line, the cylinders 22 are arranged along the longitudinal axis 78 of the block 70.

The engine 20 has one or more fluid systems 80. In the example shown, the engine 20 has a fluid system with associated jackets in the block 70 and head 72, although any number of systems is contemplated. The engine 20 has a fluid system 80 that may be at least partially integrated with a cylinder block 70, and may also be at least partially integrated with the head 72. The fluid system 80 has a jacket 84 in the block 70 fluidly connected to a jacket 86 in the head, that may act as a cooling system, a lubrication system, and the like. In other examples, the system 80 may only be provided by a jacket 84 in the block 70, and a separate cooling system may be used to cool the head 72.

In the example shown, the fluid system 80 is a cooling jacket and is provided to remove heat from the engine 20. The amount of heat removed from the engine 20 may be controlled by a cooling system controller or the engine controller. The fluid system 80 has one or more fluid jackets or circuits that may contain water, another coolant, or a lubricant as the working fluid in a liquid, vapor, or mixed phase state. In the present example, the first system 80 contains a coolant such as water, a water based coolant, a glycol based coolant, or the like. The fluid system 80 has one or more pumps 88, and a heat exchanger 90 such as a radiator. The pump 88 may be mechanically driven, e.g. by a connection to a rotating shaft of the engine, or may be electrically driven. The system 80 may also include valves, thermostats, and the like (not shown) to control the flow or pressure of fluid, or direct fluid within the system 80 during engine operation.

Various portions and passages in the fluid systems and jackets 80 may be integrally formed with the engine block and/or head as described below. Fluid passages in the fluid system 80 may be located within the cylinder block 70 and may be adjacent to and at least partially surrounding the cylinders 22 and combustion chambers 24.

Figure 2:
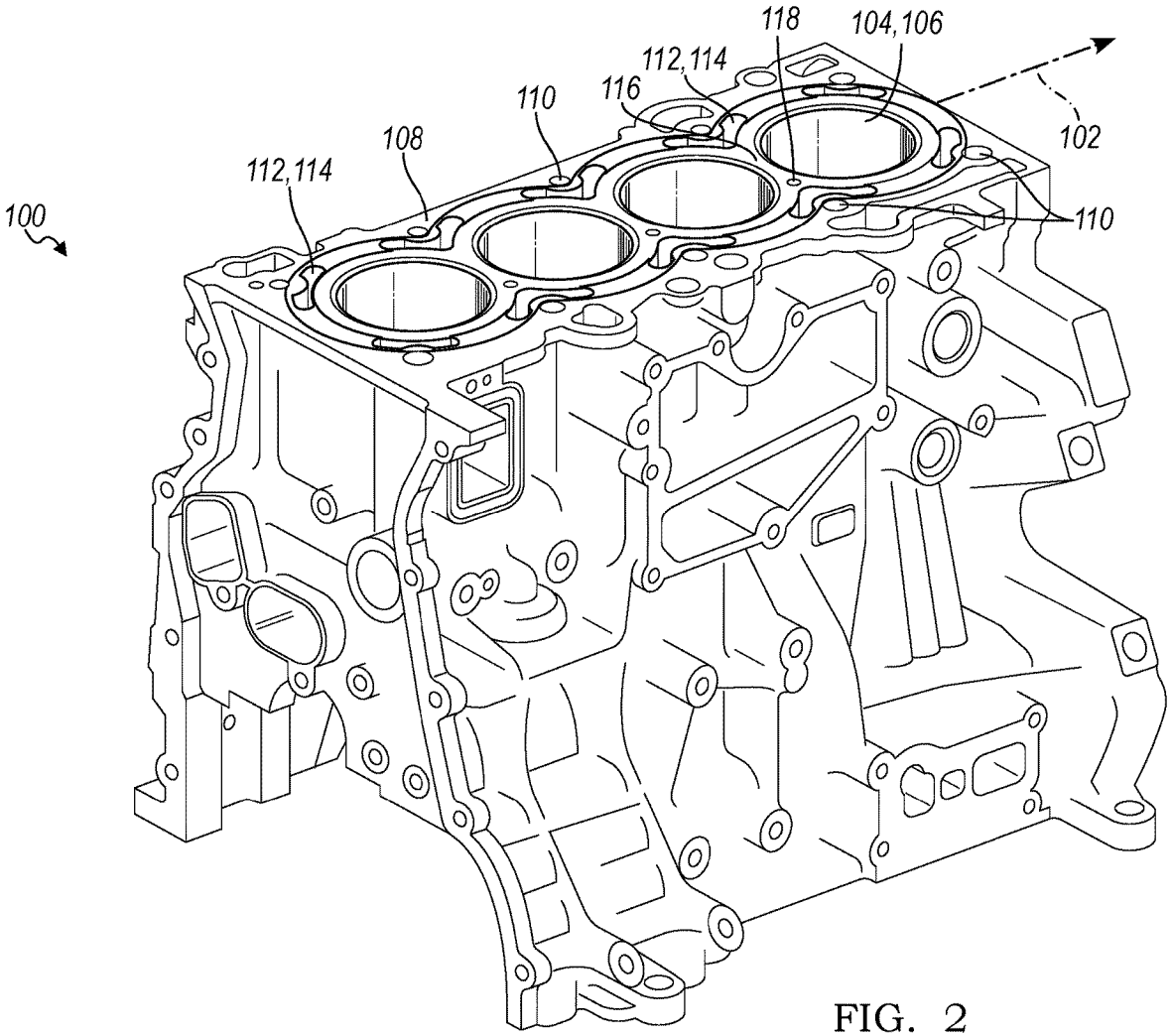
FIG. 2 illustrates a perspective view of a cylinder block according to an embodiment.

FIG. 2 illustrates a cylinder block 100 according to an embodiment. The cylinder block 100 may be used as block 70 in engine 20 described above with respect to FIG. 1. The block is provided for use with an in-line, four cylinder engine, although greater or fewer numbers of cylinders are also contemplated. The block 100 may also be used with another block to form an engine with a v-configuration for the cylinders, or other arrangements of cylinders.

The block 100 has a longitudinal axis 102. A gang 104 of siamesed cylinder liners 106 are provided in the block. The cylinders 106 intersect the deck face 108. The block 100 is formed with a closed deck face 108 or semi-open deck face. A semi-open or closed deck face 108 refers to the deck face of the block 100 being generally or substantially solid, with coolant ports provided selectively from the block cooling jacket to the corresponding ports on a head deck face. In contrast, in an open deck design, the cooling jacket continually intersects the deck face of the block about the outer perimeter of the liners, or has only a few bridge supports across the jacket at the deck face.

Surrounding the cylinders 106 are a series of head bolt bores 110 or head bolt columns 110 that receive head bolts when connecting the head to the block 100 to assemble the engine.

A cooling jacket 112 surrounds an outer perimeter of the gang 104 of cylinders and extends into the block 100 such that the jacket 112 circumferentially surrounds the liners. The jacket 112 may intersect the deck face 108 at various port locations 114 to direct coolant from the block 100 to the head. The jacket 112 is described in greater detail below.

An interbore region 116 is provided between adjacent cylinders 106. The interbore region 116 may be provided with one or more interbore cooling passages, as described below, and the interbore cooling passages may have a port 118, as shown in FIG. 1, to direct coolant from the block 100 to the head. In other examples, the interbore region 116 may be provided without a port 118.

Figure 3:
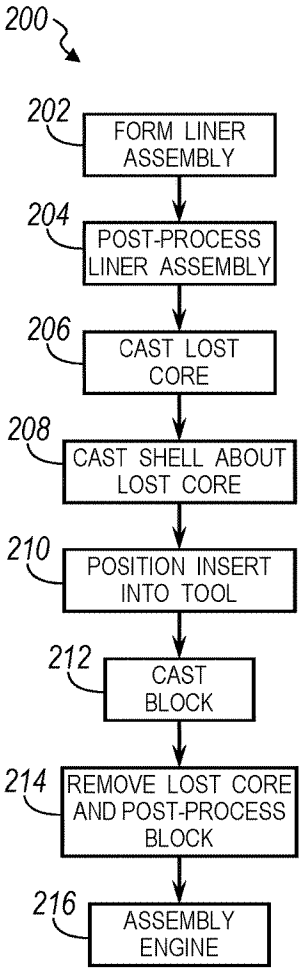
FIG. 3 illustrates a flow chart for a method of forming the cylinder block of FIG. 2 according to an embodiment.
Figure 5:
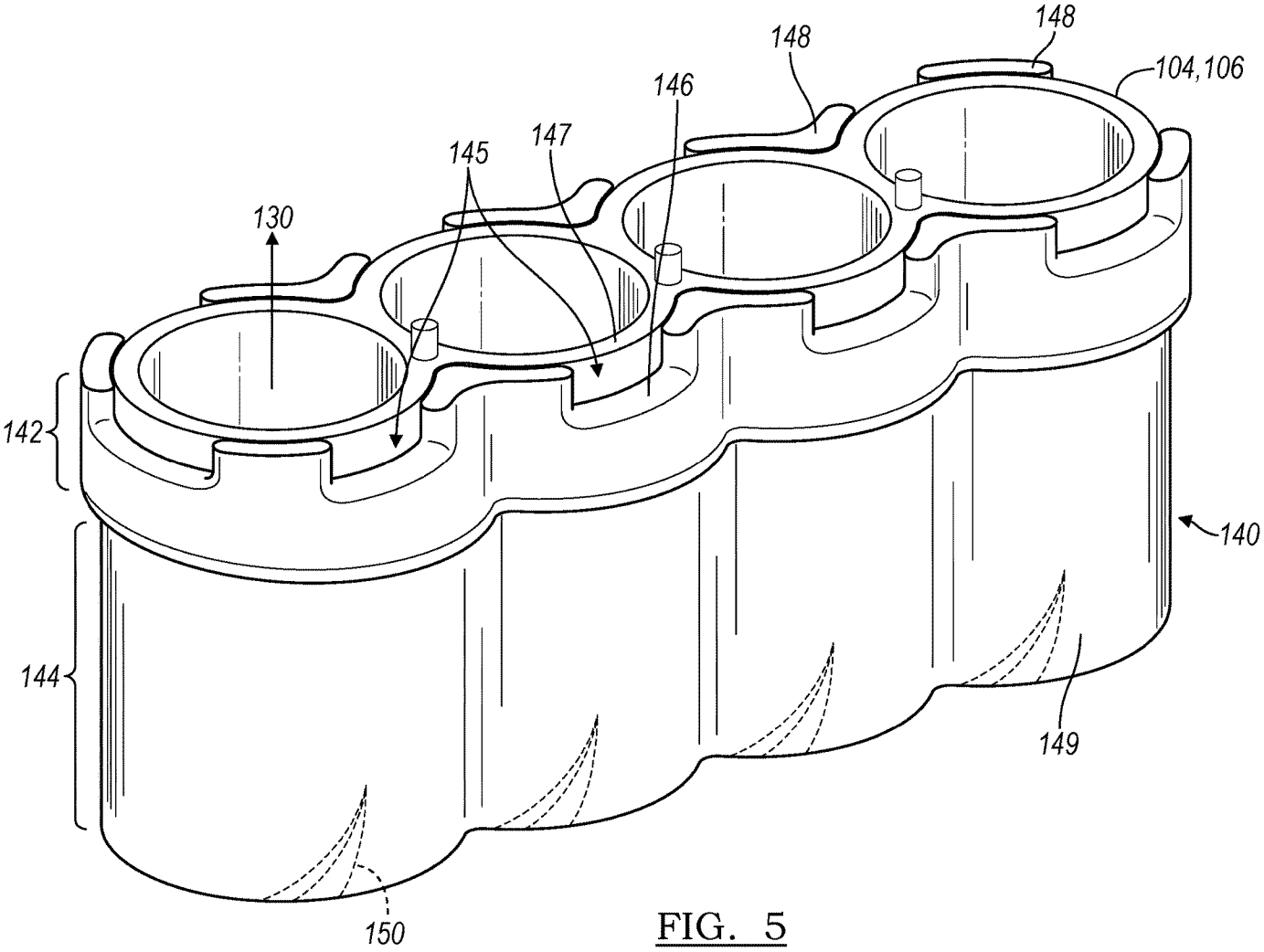
FIG. 5 illustrates a perspective view of the cylinder liner of FIG. 4 with an overmolded lost core for use in forming the cylinder block of FIG. 2.

A method and system for forming the block 100 and engine 20 is described below. FIG. 3 illustrates a flowchart of a method 200 according to an embodiment. The method 200 may include greater or fewer steps than shown, the steps may be rearranged in another order, and various steps may be performed serially or simultaneously according to various examples of the disclosure. In one example, the steps of the method 200 are performed in a sequential order as shown.

Figure 4:
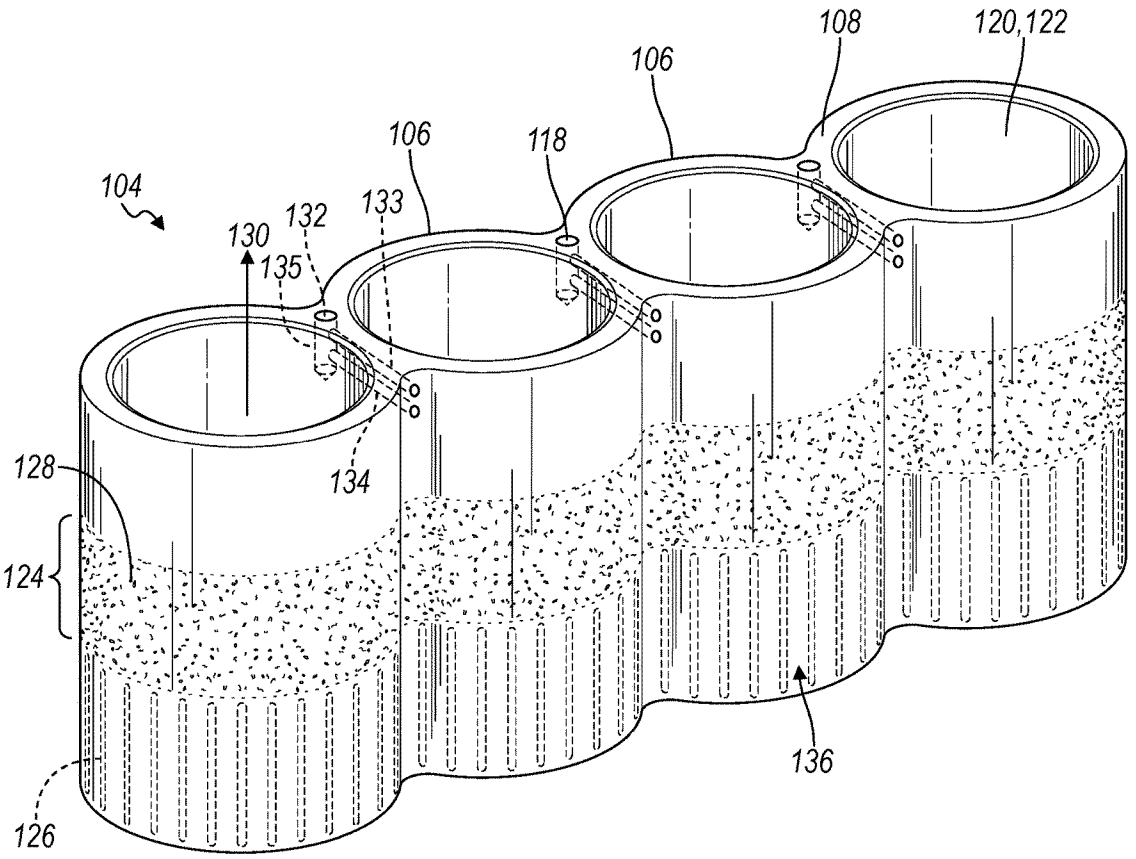
FIG. 4 illustrates a perspective view of a cylinder liner assembly for use in forming the cylinder block of FIG. 2.

The method 200 begins at step 202 where a gang 104 of liners 106 are formed. The gang 104 may be formed using an extrusion process such that the liners 106 are interconnected at the interbore regions and the resulting gang or liner assembly 104 is integrally formed with a series of siamesed cylinder liners. The liner assembly 104 may be provided by extruding the cylinder liners as an integral cylinder gang. The extrusion process provides a liner assembly 104 having a desired number of cylinders 106 at the desired length. The liner assembly 104 may be formed from an extruding process using aluminum, an aluminum alloy, a ferrous alloy, or another material. The liner assembly or gang 104 is illustrated in FIG. 4 according to an example.

At 204, the liner assembly 104 is post-processed. The liner assembly 104 may be post-processed to provide a coating 120 on an inner surface 122 of each liner wall. In one example, the inner surface 122 or interior surface of the liner assembly 104 is mechanically roughened and thermal spray coated with a sufficient coating thickness to allow for dimensional shift such that the liner assembly 104 acts as a set core insert using this inner wall 122 to position the liner assembly in the second tool as described below. In one example, the thermal spray coating 120 may be a plasma coating process. The liner assembly may be extruded and post-processed as described in U.S. patent application Ser. No. 15/056,201 filed Feb. 29, 2016, now U.S. Pat. No. 10,066,577, issued on Sep. 4, 2018, the disclosure of which is incorporated in its entirety by reference herein.

Furthermore, at least a portion of the outer surface 124 of the liner assembly may be post-processed to provide a pattern or texture on the outer surface, for example as a macro or micro texture or pattern as shown at 126, 128, respectively in broken lines as an example. In one example, at least a portion of the outer surface 124 is machined or otherwise shaped to have a pattern such as a spline, knurl, rifling, or other pattern formed in the outer surface. In another example, at least a portion of the outer surface 124 is machined or otherwise processed to a specified surface roughness, for example, as a textured surface. In another variation, the outer surface 124 may have different patterns or roughness in different regions of the liner assembly, for example, interbore versus midbore, or along an axial direction 130 of the cylinders 106, to provide further thermal control and management in the cylinder block 100. The different macro or micro structured patterns 126, 128 on the outer surface 124 of the liner assembly 104 may provide different flow and surface area characteristics that lead to different heat transfer rates along the length of the bore to maintain a more uniform bore wall temperature. In other examples, the liner assembly may be provided for use where the outer surface 124 is the extruded surface and is without textures or patterns 126, 128.

Interbore passages 132 are machined into the assembly 104 between adjacent cylinders. Because the liner assembly 104 is easily manipulated and free of surrounding structure at this time, interbore passages 132 may be machined using a drilling or milling process with ease of access and flexibility as to the tooling angle relative to the assembly 104. The assembly 104 is shown as having identical interbore passages 132 at the various interbore locations; however, different shape and/or size passages may be provided at different interbore locations based on the engine cooling requirements and strategies. The interbore passages 132 may be provided by cross-drilling the liner assembly such that a passage extends from the first side towards a second opposite side of the liner assembly.

In the present example, the interbore passage 132 is provided by a first and second interbore passages 133, 134 that are spaced apart from the deck face 108 and from one another. The first and second passages 133, 134 may intersect a first side 136 of the liner assembly 104 and may extend generally across the liner assembly to a blind depth. In other examples, the first and second passages 133, 134 may extend through the liner assembly to a second, opposed side. The first and second interbore passages 133, 134 may be parallel to one another, and may also be parallel to the deck face 108. In other examples, the first and second passages 133, 134 may be nonparallel to one another, and one or both of the passages may be nonparallel with the deck face 108. The first and second passages 133, 134 may be the same size as one another, or different sizes. The first and second passages 133, 134 may be interconnected by a third passage 135 that intersects the deck face 108 and provides the port 118. The third passage 135 may be generally perpendicular to or otherwise angled relative to the deck face 108, and may be larger in diameter than the first or second passages 133, 134. In further examples, additional passages may be provided that are similar to the first and second passages in an interbore region that intersect the third passage.

At step 206, a lost core is formed about the liner assembly 104. The lost core 140 may be a salt core, a sand core, a glass core, a foam core, or another lost core material as appropriate. In one example, the lost core material includes a potassium chloride or sodium chloride. The lost core 140 is formed in a predetermined shape and size about the liner assembly 104. The core 140 is provided generally in the desired shape and size of the cooling jacket 112, and also to form the inlet and outlet coolant feed paths. The lost core material may fill the interbore passages 132 in the liner assembly. The lost core material, as protected by the shell as described below, allows for a resulting cast-in cooling jacket 112 with features having a fillet radius of less than two millimeters, or even less than one millimeter without loss of integrity.

The lost core 140 material may be formed with different thicknesses at different axial positions along the liner assembly 104. The lost core 140 may be formed with a decreasing thickness along an axial length of the liner assembly, with generally constant thicknesses in different regions. The lost core 140 may be cast with a first thickness on an upper region 142 of the liner assembly adjacent to the interbore passage and a second thickness on a lower region 144 of the liner assembly, with the first thickness being greater than the second thickness to provide a higher volume of coolant adjacent to the upper, warmer regions of the cylinders to provide uniform cooling and temperature along the axial length of the cylinder and reduce liner distortion. In one example, the lost core 140, and resulting cooling jacket 112 has little draft or no draft angle. Furthermore, in other examples, the lost core 140 may have regions of increased thickness in intermediate or regions of the liner assembly 104 away from the deck face 108, contrary to conventional cooling jackets.

The lost core 140 may also be selectively formed about the liner assembly 104. The lost core may be cast about the outer surface of the liner assembly 104 to have alternating regions 145 that are spaced apart from and directly adjacent to an upper end of the liner assembly 104 about an outer circumference of the liners. Therefore, an upper edge 146 of the lost core material may be spaced apart from an upper edge 147 of the cylinder liners 106, at least in regions about the perimeter of the liner assembly 104. Later, during step 208 as described below, the shell is cast to fill these regions 145 that are spaced apart from the upper end of the liners such that the block 100 is cast to have a closed deck face or semi-open deck face. Sections 148 of the lost core 140 are co-planar with the upper edge 147 of the liner assembly 104. These sections 148 provide resulting cooling ports 114 for the jacket 112 in the finished block 100.

The lost core 140 may be formed with a pattern on an outer surface 149 of the lost core when casting the lost core. The pattern 150 may be formed as a negative into the lost core to later result in a fluid guide formed in an outer wall of the cooling jacket 112 of the block. In one example, the pattern 150 is positioned at defined locations in the core 140 about the liner assembly 104 as a guide shape that is configured to form guides to direct coolant towards the interbore passages, towards an interbore region, to cause stirring or mixing of the coolant between different depths in the cooling jacket, to direct the coolant into the jacket or out of the jacket, and the like. For example, the patterns 150 may be positioned to form straight, curved, or other complex shapes, guides, or fins that are configured to enhance mixing or swirl of coolant at various locations in the cooling jacket 112 to reduce coolant temperature variation in the jacket.

Figure 6:
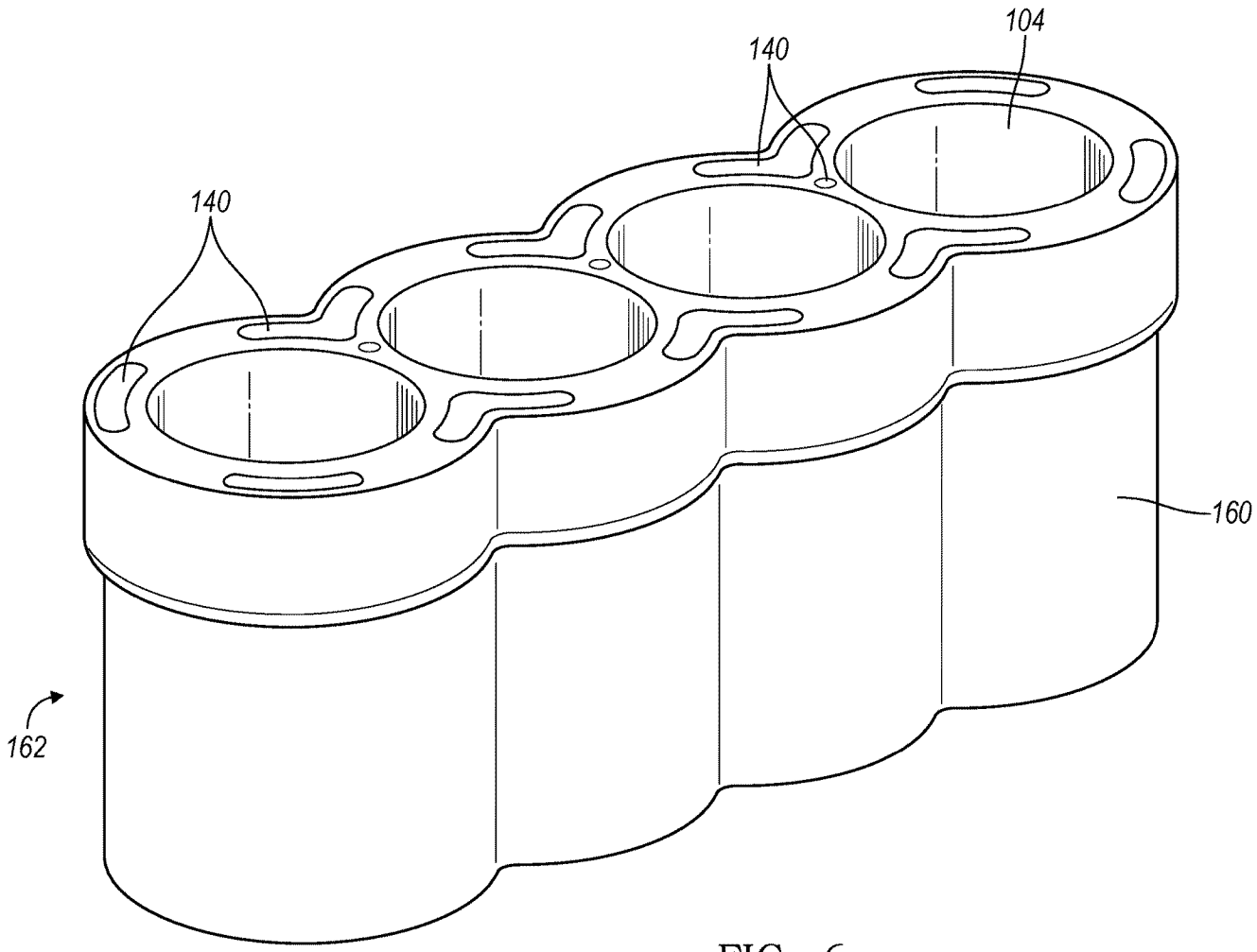
FIG. 6 illustrates a perspective view of an insert for use in forming the cylinder block of FIG. 2, the insert incorporating the lost core overmolded liner assembly of FIG. 5.
Figure 8:
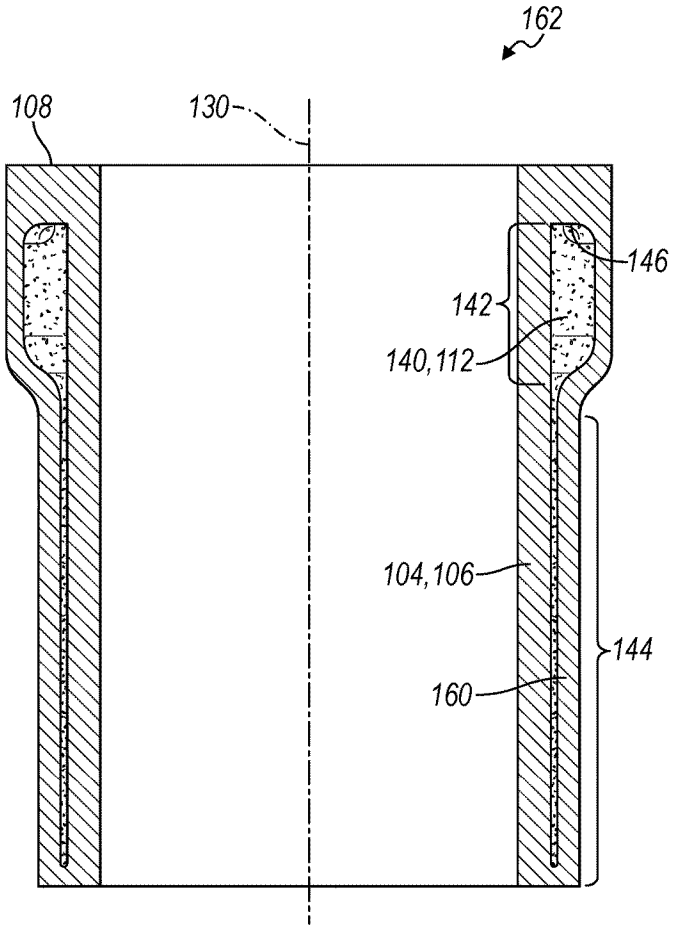
FIG. 8 illustrates another second sectional view of the insert of FIG. 6.
Figure 7:
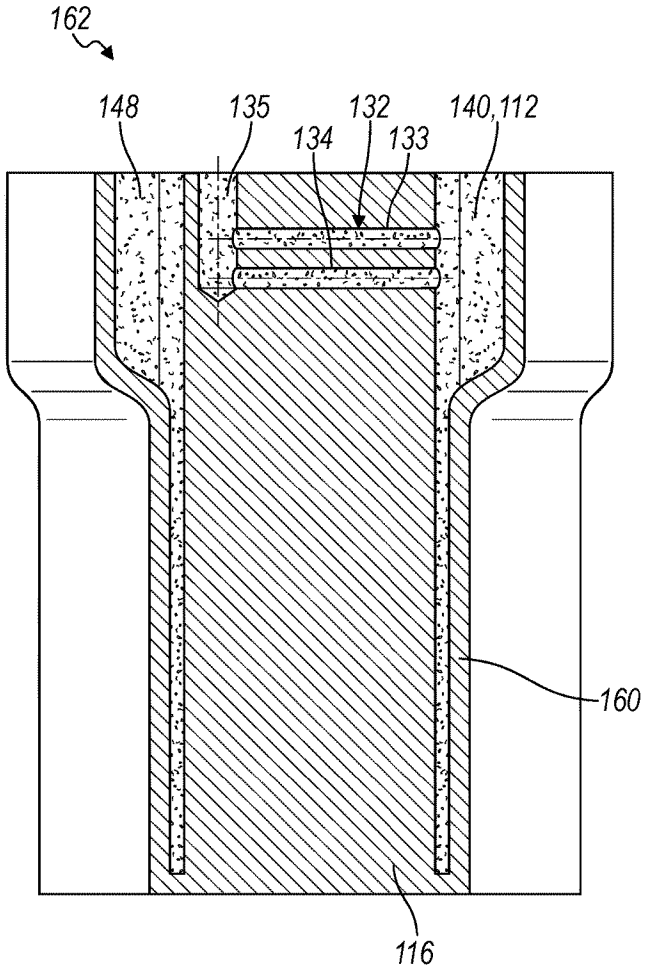
FIG. 7 illustrates a sectional view of the insert of FIG. 6.

At step 208, the liner assembly 104 and cast lost core 140 material is encapsulated with a shell 160 to form an insert 162. An example of an insert 162 is illustrated in FIGS. 6-8. A shell 160 surrounds or encapsulates the lost core 140 such that it covers at least a portion of the outer surface of the lost core 140. The shell 160 may completely encapsulate the core 140, or may cover a portion of the core 140. If a region of the core 140 is left uncovered, it does not interact with the injected material during formation of the engine block 100 to prevent destruction of the core 140.

In one example, a die casting or casting process is used to form the shell 160 while maintaining the integrity of the lost core 140. A first die, mold, or tool may be provided with the shape of the insert 162. The liner assembly 104 and core 140 is positioned within the die, and the shell 160 is cast or otherwise formed around the core 140. The shell 160 may be formed by a low pressure casting process by injecting molten metal or another material into the mold. The molten metal may be injected at a low pressure between 2-10 psi, 2-5 psi, or another similar low pressure range using a gravity feed. The material used to form the shell 160 may be the same metal or metal alloy as used to form the block 100, or may be a different material from the engine block. In one example, the shell 160 is formed from aluminum or an aluminum alloy and the block 100 is formed from aluminum, an aluminum alloy, a composite material, a polymer, and the like. By providing the molten metal at a low pressure, the lost core 140 retains its desired shape and is retained within the shell 160. After the shell 160 cools, the insert 162 is ejected from the first tool and may be ready for use. The insert 162 is therefore formed before use with a second tool to die cast or otherwise form the block 100.

In one example, the outer surface of the shell 160 and insert 162 may be coated to reduce oxidation, for example on a lower outer portion of the liner assembly. The insert 162 may have an outer surface that is acid dipped, for example in fluoritic acid, and then rinsed to reduce oxidation and possible porosity issues in adjacent cast block material in a finished block.

Figure 9:
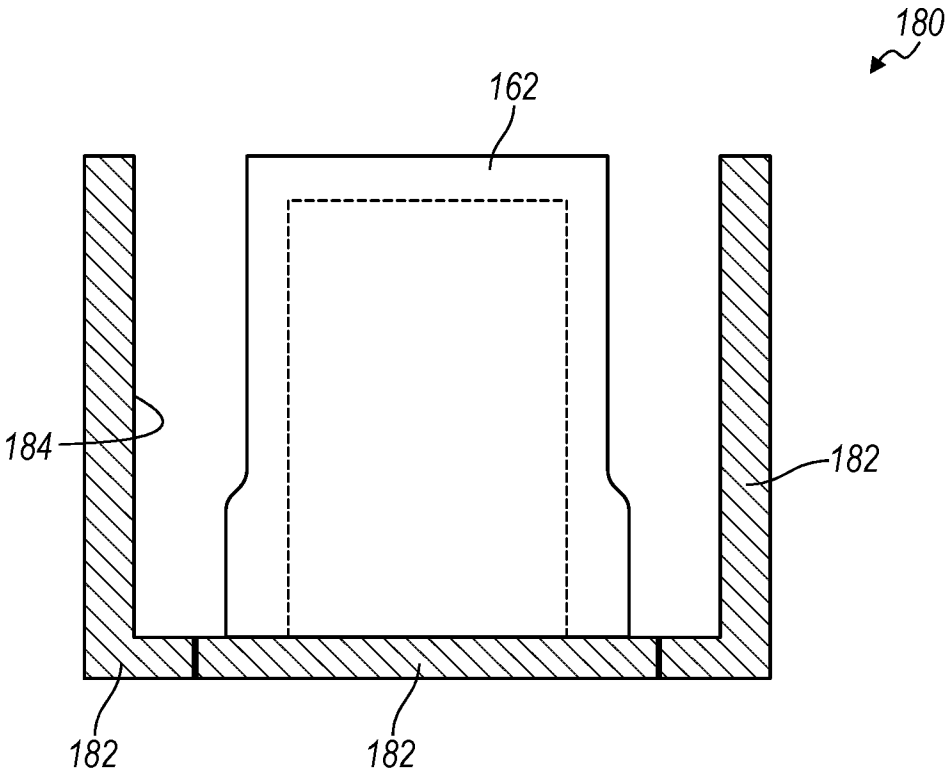
FIG. 9 illustrates a schematic of a tool for use in forming the cylinder block of FIG. 2 using the insert of FIG. 6.

After the insert 162 is formed at step 208, the insert 162 is inserted and positioned within a second tool at step 210, and various dies, slides or other components of the second tool are moved to close the tool in preparation for an injection or casting process. As shown schematically in FIG. 9, the second tool 180 includes dies and slides 182 that are configured to receive the insert 162 and that have a cylinder block forming surface 184. In one example, the second tool 180 is provided as a tool for a high pressure die casting process of metal, such as aluminum or an aluminum alloy. The insert 162 and the second tool 180 are provided with corresponding locating features that allow for the insert 162 to be positioned within, and constrained by the second tool 180 during the casting process for the block to prevent movement of the insert 162. In one example, the insert 162 is located using the inner surface of the liners.

After the second tool 180 is closed with the insert 162 positioned and constrained in the tool, material is injected or otherwise provided to the tool at step 212 to generally form the engine block 100. In one example, the material is a metal such as aluminum, an aluminum alloy, or another metal that is injected into the tool as a molten metal in a high pressure die casting process. In a high pressure die casting process, the molten metal may be injected into the tool at a pressure of at least 20,000 pounds per square inch (psi). The molten metal may be injected at a pressure greater than or less than 20,000 psi, for example, in the range of 15,000-30,000 psi, and may be based on the metal or metal alloy in use, the shape of the mold cavity, and other considerations.

The molten metal flows into the tool 180 and into contact with the outer shell 160 of the insert 162 and forms a casting skin around the insert 162. The shell 160 of the insert may be partially melted to meld with the injected metal. Without the shell 160, the injected molten metal may disintegrate or deform the lost core 140. By providing the shell 160, the core 140 remains intact for later processing to form the passages and jackets, and allows for small dimensional passages such as the interbore passages to be formed.

The molten metal cools in the second tool to form an unfinished engine block, which is then removed from the tool.

At step 214, the engine block 100 undergoes various finishing steps. The process in step 212 may be a near net shape casting or molding process such that little post-processing work needs to be conducted.

In the present example, the insert 162 remains in the unfinished block after removal from the tool. The casting skin surrounds the lost core 140 material. The casting skin may contain at least a portion of the shell 160. A surface of the unfinished block may be machined to form the deck face 108 of the block, for example, by milling. The unfinished block may also be cubed or otherwise machined to provide the final block 100 for use in engine assembly.

The lost core 140 may be removed using pressurized fluid, such as a high pressure water jet or other solvent. In other examples, the lost core 140 may be removed using other techniques as are known in the art. The lost core 140 is called a lost core in the present disclosure based on the ability to remove the core in a post die casting process. The lost core 140 in the present disclosure remains intact during the die casting process due to the shell 160 surrounding it. After the core 140 has been removed, the skin or outer shell 160 provides the wall and shape of the fluid jackets 112 as described for the formed engine block 100 and the interbore passages 132 are re-opened to provide for fluid flow therethrough.

The lost core 140 region of FIGS. 7-8 for the insert 162 provide an illustration of the shape and size of the final cooling jacket 112 when the lost core material is removed from the finished block 100. FIG. 7 illustrates a sectional view taken through an interbore region of the insert. FIG. 8 illustrates a sectional view taken through a midbore region of the insert.

According to one example, and as shown, the cooling jacket has an upper wall 146 that is periodically spaced apart from the deck face 108 of the block. The cooling jacket 112 has a first width along a lower axial section 144 of the liner assembly, and has a second width along an upper axial section 142 of the liner assembly. The upper axial section 142 is positioned between the deck face 108 and the first axial section 144, with the first width being less than the second width. An interbore region 116 of the first and second cylinders defines first and second interbore cooling passages 133, 134 extending thereacross, with the first and second interbore passages spaced apart from the deck face 108 and parallel to one another.

By using the insert 162 structure as described, the features may be provided within a finished engine block 100 with precision, accuracy, and control over complex geometry and small dimensions, i.e. on the order of millimeters. This allows for the formation of passages with small dimensions in difficult to position locations, such as the interbore passages 132, as well as the formation of a cooling jacket 112 structure with the desired geometry to improve thermal management and cooling of the block. Additionally, the one-piece insert 162 provides for increased strength and stability of the block, as well as improved knock sensing.

The insert 162 and method of forming an engine cylinder block 100 as described herein provides for a cylinder block design with a cooling jacket 112 that provides sufficient thermal management for the block to operate below the materials given mechanical properties, such as ultimate yield strength at high operating temperatures. Conventional high pressure die casting of a block does not allow for the manufacture a thin deep water jacket, especially with a closed or semi-open deck face and with limited post-processing of the block. The block 100 and method 200 of forming the block as disclosed herein provides a small compact cooling jacket in a closed or semi-open deck face 108, which allows for improved detection of pre-ignition conditions in the engine, e.g. spark knock. Generally, pre-ignition conditions in an engine may be related to engine design and operating variables which influence end-gas temperatures, pressures, and time spent at high values of these two properties before flame arrival. Pre-ignition conditions or knock may also be influenced by low octane rated fuels used along with operating conditions where high heat flux is present within the combustion chambers structure. Generally, a flame caused by pre-ignition conditions may form near the crevice volume, or piston to bore clearance above top fire ring, where hydrocarbon build up may occur and a high heat flux is present. Controlling the head deck design as disclosed herein to form a direct path of spark knock detection may provide increased sensitivity for an engine knock sensor and improved control over retarding the spark advance to mitigate knock and protect the engine.

The cylinder block 100 as disclosed also controlled heat transfer over the length of the cylinder bore 106, including in the siamesed region, or interbore region, between cylinder bores on a multi-cylinder engines, for example, through use of the interbore cooling passages 132 and guides for cooling flow in the cooling jacket 112.

The insert 162 provides a solution for the packaging constraints of the block 100, and also provides a block with enhanced structural stiffness. Packaging constraints may include the size and position of various engine components such as bore size, bore wall thickness, head bolt spacing, cylinder bore spacing, head bolt size, and head bolt thread depth.

The insert 162 provides for both a controlled, precision flow and mixing of the coolant in the jacket 112 by providing for a controlled cooling jacket size and thermal management of the block 100 to provide a more uniform bore wall temperature without requiring high coolant velocities. Additionally, the insert 162 of the present disclosure provides for increased structural stiffness that is delivered by the combined material properties of the extruded liner assembly 104 and mechanical properties of the alloy choices of the shell 160 in the low pressure die cast process. Use of a one-piece insert 162 provides for an increase in bore wall stability in the block 100 as well as better positioning of the cylinder liners in the block for use with a fixed head bolt pattern. Spark knock sensitivity of the engine is increased by the closed or semi-open deck 108 design and where the coolant leaves block via ports 114 in the block deck face. An increase in knock sensing may provide for improved spark control, increased fuel economy, and an increased engine power output. A conventional high pressure die cast block has a significant amount of residual stress adjacent to and surrounding the cylinder bore walls, and additionally quality checks may be needed during production, especially when used with higher horsepower engine designs. Conventional cylinder bore walls may become thin near the head bolt bores and columns due to cooling jacket size and draft angle, such that this stressed location may result in cracked liners or weak aluminum oxide rich pockets. Additionally, a cracked head bolt boss resulting from residual stress may lead to reduced integrity of the cooling jacket and possible sealing issues.

Additionally, various blocks and engines may be formed using the method 200 as described herein for use with other engine cooling configurations or engine designs, including parallel flow, series flow, cross flow, split flow, or various combinations thereof.

While exemplary embodiments are described above, it is not intended that these embodiments describe all possible forms of the disclosure. Rather, the words used in the specification are words of description rather than limitation, and it is understood that various changes may be made without departing from the spirit and scope of the disclosure. Additionally, the features of various implementing embodiments may be combined to form further embodiments of the disclosure.

What is claimed is:

1. A method of forming an engine comprising:
forming an interbore passage between first and second siamesed cylinder liners;
casting a lost core about an outer surface of the liners;
casting a metal shell about the lost core and the liners to form an insert;
positioning the insert into a tool;
casting an engine block about the insert in the tool; and
removing the lost core from the block to form a cooling jacket.

2. The method of claim 1 wherein forming the interbore passage, casting the lost core, casting the metal shell, positioning the insert, casting the engine block, and removing the lost core are are performed in sequential order.

3. The method of claim 1 further comprising forming a pattern on an outer portion of the lost core when casting the lost core, the pattern resulting in a fluid guide formed in an outer wall of the cooling jacket of the block.

4. The method of claim 1 wherein the interbore passage is formed by cross-drilling at least one passage to extend from a first side towards a second side of the first and second liners.

5. The method of claim 4 wherein the at least one passage is formed to be parallel to a deck face of the block.

6. The method of claim 5 wherein the at least one passage comprises first and second passages parallel with the deck face of the block.

7. The method of claim 1 wherein the lost core is cast about the outer surface of the liners to have alternating regions that are spaced apart from and directly adjacent to an upper end of the liners about an outer circumference of the liners, and wherein the metal shell is cast to fill the regions that are spaced apart from the upper end of the liners such that the block is cast to have a closed deck face.

8. The method of claim 1 further comprising extruding the first and second cylinder liners as an integral cylinder gang.

9. The method of claim 1 further comprising plasma coating an interior surface of each of the cylinder liners.

10. The method of claim 1 further comprising coating an outer surface of the insert prior to casting the engine block.

11. A method comprising:
forming an interbore passage between first and second siamesed cylinder liners;
forming a textured surface on an outer surface of the liners prior to casting a lost core about the outer surface;
casting a metal shell about the lost core and the liners to form an insert;
casting an engine block about the insert positioned in a tool; and
removing the lost core from the block to form a cooling jacket.

12. The method of claim 11 wherein the textured surface is formed on only an axial portion of the outer surface of the liners.

13. The method of claim 11 wherein the lost core is cast with a decreasing thickness in an axial direction of the liners.

14. The method of claim 11 wherein the lost core is cast such that an upper edge of the lost core is spaced apart from an upper edge of the liners.

15. The method of claim 11 further comprising forming a pattern on an outer portion of the lost core, the pattern resulting in a fluid guide formed in an outer wall of the cooling jacket of the block.

16. A method comprising:
forming an interbore passage between first and second siamesed cylinder liners;
casting a lost core about an outer surface of the liners with a first thickness on an upper region of the first and second liners adjacent to the interbore passage and a second thickness on a lower region of the first and second liners, the first thickness greater than the second thickness;
casting a metal shell about the lost core and the liners to form an insert;
positioning the insert into a tool;
casting an engine block about the insert in the tool; and
removing the lost core from the block to form a cooling jacket.

17. The method of claim 16 further comprising forming a pattern in the lost core as a guide shape to direct coolant flow in the cooling jacket.

18. The method of claim 16 wherein the lost core is cast about the liners such that an upper edge of the lost core is spaced apart from an upper edge of the liners.

19. The method of claim 16 wherein the lost core is cast about the outer surface of the liners to have alternating regions that are spaced apart from and directly adjacent to an upper end of the liners about an outer circumference of the liners, and wherein the metal shell is cast to fill the regions that are spaced apart from the upper end of the liners such that the block is cast to have a closed deck face.

20. The method of claim 16 further comprising coating an inner surface of the liners with a plasma coating; and
forming a texture on an outer surface of the liners.

* * * * *